United States Patent [19]

Sakai

[11] 4,335,194

[45] Jun. 15, 1982

[54] TWO COLOR ELECTROPHOTOGRAPHIC PROCESS AND MATERIAL

[75] Inventor: Katsuo Sakai, Tokyo, Japan

[73] Assignee: Ricoh Company, Ltd., Tokyo, Japan

[21] Appl. No.: 12,571

[22] Filed: Feb. 15, 1979

[30] Foreign Application Priority Data

| | | | |
|---|---|---|---|
| Feb. 20, 1978 | [JP] | Japan | 53-18754 |
| Apr. 25, 1978 | [JP] | Japan | 53-49671 |
| Nov. 28, 1978 | [JP] | Japan | 53-146998 |
| Nov. 28, 1978 | [JP] | Japan | 53-146999 |

[51] Int. Cl.[3] ..... G03G 13/01; G03G 13/22

[52] U.S. Cl. ..... 430/42; 430/31; 430/46; 430/55; 430/64; 430/67; 430/902

[58] Field of Search ..... 430/31, 42, 46, 55, 430/64, 67

[56] References Cited

U.S. PATENT DOCUMENTS

| | | | |
|---|---|---|---|
| 2,962,375 | 11/1960 | Schaffert | 430/46 |
| 3,647,427 | 3/1972 | Hanada et al. | 430/67 X |
| 3,679,405 | 7/1972 | Makino et al. | 430/64 X |
| 3,692,519 | 9/1972 | Takahashi | 430/42 |
| 3,775,106 | 11/1973 | Tamai et al. | 430/42 |
| 3,795,513 | 3/1974 | Ciuffini | 430/84 X |
| 3,801,317 | 4/1974 | Tanaka et al. | 430/67 X |
| 3,844,783 | 10/1974 | Matsumoto et al. | 430/43 |
| 3,884,686 | 5/1975 | Bean | 430/43 |
| 4,039,831 | 8/1977 | Lehmann | 430/42 |
| 4,078,929 | 3/1978 | Gundlach | 430/31 |

OTHER PUBLICATIONS

Schaffert, "Increasing the Sensitivity of Xerographic Photoconductors", IBM Tech. Discl. Bull., vol. 6, No. 10, Mar. 1964, p. 60.

*Primary Examiner*—Roland E. Martin, Jr.
*Attorney, Agent, or Firm*—David G. Alexander

[57] ABSTRACT

A photoconductive material (11) coated on a drum, belt or sheet (22) is formed with a first photoconductive layer (11*b*) which is insensitive to red light, a second photoconductive layer (11*d*) which is sensitive to red light and a transparent insulating layer (11*c*) formed either between the photoconductive layers (11*b*), (11*d*) or on top thereof. The outer surface of the material (11) is radiated with white light while applying a first electrostatic charge thereto rendering both photoconductive layers (11*b*), (11*d*) photoconductive. Then, the material (11) is radiated with red light rendering only the second photoconductive layer (11*d*) photoconductive while applying an electrostatic charge of opposite polarity. Then, a third electrostatic charge of the same polarity as the first electrostatic charge is applied in the dark. The result is that electrostatic charges of opposite polarities are formed at the outer surfaces of the first and second photoconductive layers (11*b*), (11*d*). Radiation of a colored light image on the material (11) causes both photoconductive layers (11*b*), (11*d*) to conduct and dissipate charge in white image areas, only the second photoconductive layer (11*d*) to conduct in red image areas and no photoconduction in black image areas in such a manner that the surface potential is opposite in polarity in the red and black areas and zero in the white areas. Red and black toners of opposite electrostatic charge are applied to the material (11) to form a two color toner image which is transferred to a copy sheet (36) and fixed as required.

21 Claims, 59 Drawing Figures

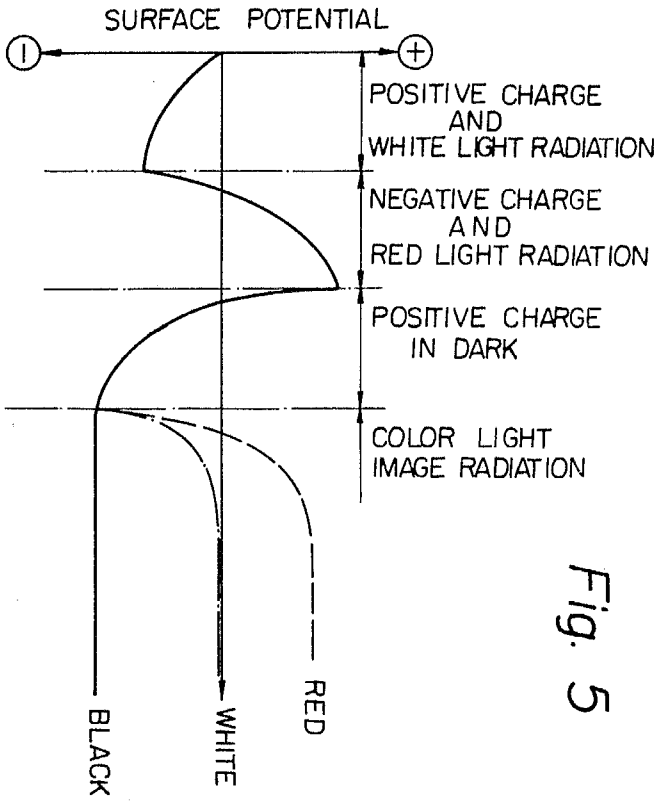
Fig. 5
Fig. 6
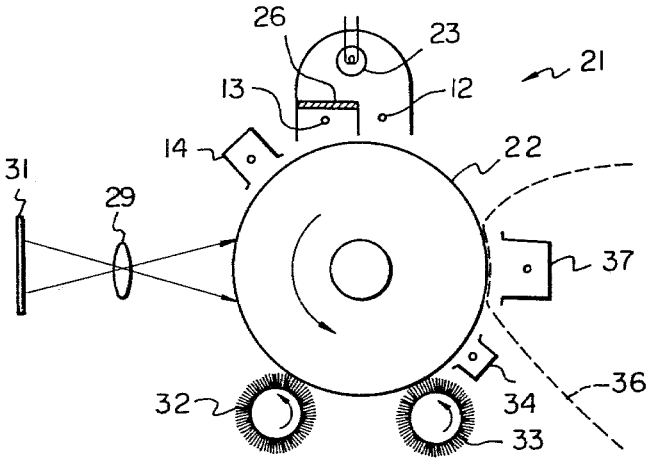

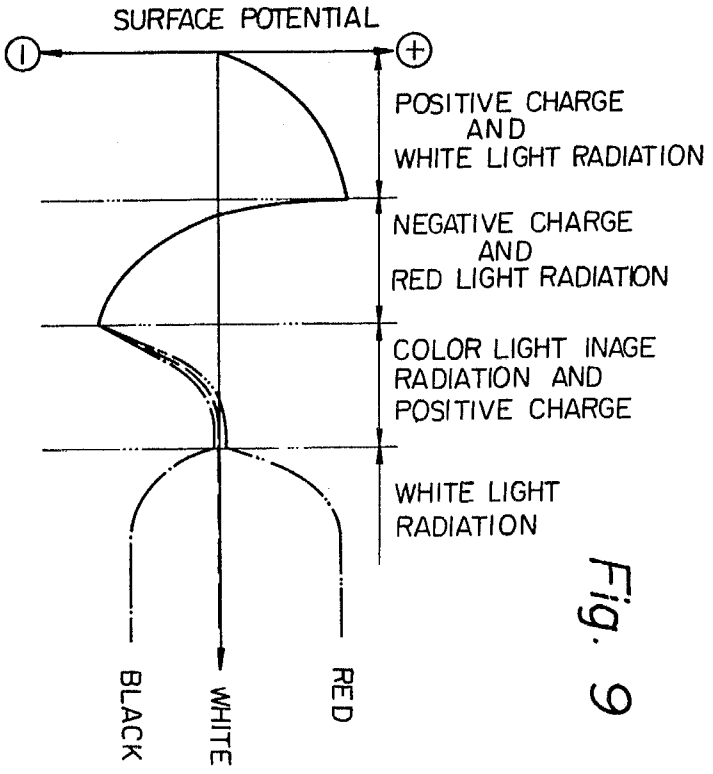
Fig. 9
Fig. 10
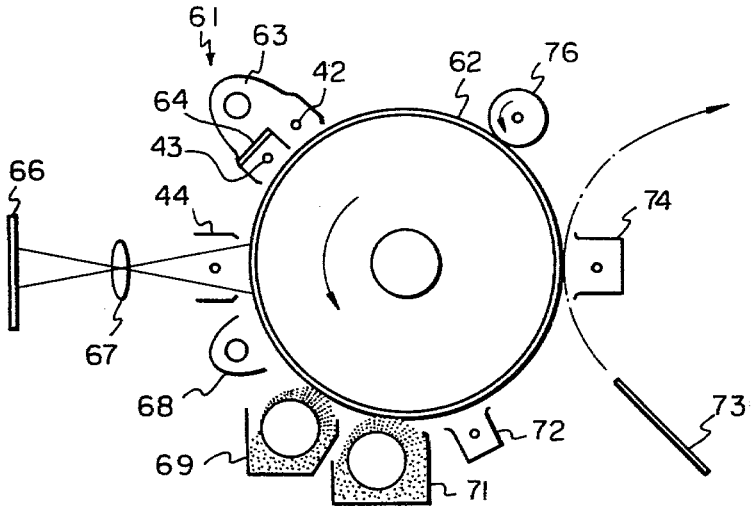

TWO COLOR ELECTROPHOTOGRAPHIC PROCESS AND MATERIAL

BACKGROUND OF THE INVENTION

The present invention relates to a two color electrophotographic or electrostatic copying process and material.

A novel and unique two color electrostatic copying process is disclosed in copending U.S. patent application Ser. No. 912,273, filed June 5, 1978, entitled "COLOR ELECTROSTATOGRAPHIC PROCESS AND MATERIAL FOR PRACTICING SAME" which is assigned to the same assignee as this application. The present invention constitutes an improved process and material capable of producing even higher quality two color copies.

Color electrostatic copying machines which produce full color copies are known in the art. These are generally of two types. The first type comprises a single photoconductive drum or belt which is exposed to a light image of an original document three times through filters of three primary colors respectively. After each imaging operation, a toner substance of a corresponding color is applied to the drum to form a color toner image which is transferred to a copy sheet. In this manner, three color toner images are sequentially formed on the drum and transferred to the copy sheet in register to produce a color copy. Often, a fourth black toner image is formed and transferred to the copy sheet in register with the three color toner images.

In such a copy machine it is essential that the toner images be transferred to the copy sheet in perfect register. The control mechanism for such a copying machine is therefore intricate and expensive. The three or four imaging operations for each copy require a disproportionate amount of time, making the process very slow.

The second type of color copying machine is much faster in operation but also much more expensive to manufacture. Such a copying machine comprises three or four photoconductive drums or belts. The original document is passed over all of the drums in one scanning movement, sequentially imaging the drums through three respective primary color filters. A toner development unit is associated with each drum. The copy sheet is fed through the machine in one pass, with the toner images being transferred thereto in register through sequential engagement with the drums.

In addition to the increased cost of the three or four drums compared to only one drum or belt in the first type of color copying machine, an intricate mechanism is also required in the second type of machine to ensure perfect register of the three of four toner images on the copy sheet.

A full color copying machine is unnecessary in many business operations where only commercial documents are copied, since such documents generally only comprise the colors black and red, in addition to a white background. This is because accounting records and the like generally contain credit entries in black and debit entries in red. Since in many such documents the debit and credit entries may be distinguished from each other only by the color of ink, many offices have purchased or leased full color copying machines for copying such records. The full color copying capability is wasted since it is only necessary to distinguish red from black on the copies.

SUMMARY OF THE INVENTION

A two color electrophotographic process embodying the present invention comprises the steps of providing a material including a first photoconductive layer which is insensitive to light of a predetermined color, a second photoconductive layer which is sensitive to light of the predetermined color and a transparent insulating layer, forming an electrostatic charge pattern in the material in such a manner that electrostatic charges of opposite polarities are formed at outer surfaces of the first and second photoconductive layers respectively, radiating a color light image onto an outer surface of the material and applying two toners of different colors which are charged to opposite electrostatic polarities respectively to the outer surface of the material.

In accordance with the present invention, a photoconductive meterial coated on a drum, belt or sheet is formed with a first photoconductive layer which is insensitive to red light, a second photoconductive layer which is sensitive to red light and a transparent insulating layer formed either between the photoconductive layers or on top thereof. The outer surface of the material is radiated with white light while applying a first electrostatic charge thereto rendering both photoconductive layers photoconductive. Then, the material is radiated with red light rendering only the second photoconductive layer photoconductive while applying an electrostatic charge of opposite polarity. Then, a third electrostatic charge of the same polarity as the first electrostatic charge is applied in the dark. The result is that electrostatic charges of opposite polarities are formed at the outer surfaces of the first and second photoconductive layers. Radiation of a colored light image on the material causes both photoconductive layers to conduct and dissipate charge in white image areas, only the second photoconductive layer to conduct in red image areas and no photoconduction in black image areas in such a manner that the surface potential is opposite in polarity in the red and black areas and zero in the white areas. Red and black toners of opposite electrostatic charge are applied to the material to form a two color toner image which is transferred to a copy sheet and fixed as required.

It is an object of the present invention to provide a two color copying process which produces improved quality two color reproductions.

It is another object of the present invention to provide a photoconductive material for performing the process.

It is another object of the present invention to provide a two color copying process which may be performed faster and using substantially less expensive and complicated apparatus than has been heretofore possible.

It is another object of the present invention to provide a generally improved electrophotographic process and material.

Other objects, together with the foregoing, are attained in the embodiments described in the following description and illustrated in the accompanying drawing.

BRIEF DESCRIPTION OF THE DRAWING

FIG. 5 is a graph illustrating the operation of the processes of FIGS. 1*a* to 1*e*, 2*a* to 2*e*, 3*a* to 3*e* and 4*a* to 4*e*;

FIG. 6 is a schematic diagram of an apparatus for performing the processes of FIGS. 1*a* to 1*e*, 2*a* to 2*e*, 3*a* to 3*e* and 4*a* to 4*e*;

FIG. 9 is a graph illustrating the operation of the processes of FIGS. 7*a* to 7*e* and 8*a* to 8*e*;

FIG. 10 is a schematic diagram of an apparatus for performing the process of FIGS. 7*a* to 7*e*;

DESCRIPTION OF THE PREFERRED EMBODIMENTS

Figure 1A:
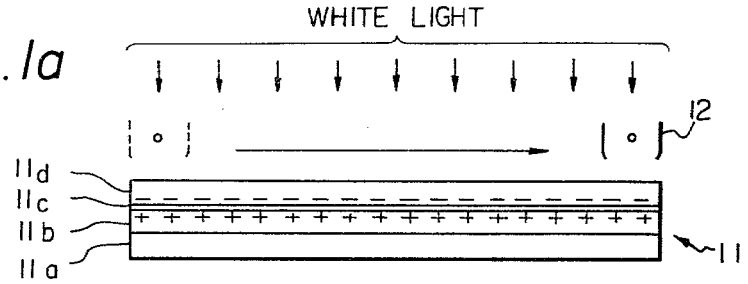
FIGS. 1*a* to 1*e* are diagrams illustrating an electrophotographic process and material of the invention.

While the electrophotographic process and material of the present invention is susceptible of numerous physical embodiments, depending upon the environment and requirements of use, substantial numbers of the herein shown and described embodiments have been made, tested and used, and all have performed in an eminently satisfactory manner.

Referring now to FIGS. 1*a* to 1*e* of the drawing, a photoconductive material embodying the present invention is generally designated by the reference numeral 11 and comprises an electrically conductive, preferably grounded substrate 11*a* which may be in the form of a drum or belt. A photoconductive layer 11*b* which is insensitive to red light but sensitive to light of at least one other color is formed on the substrate 11*a*. A transparent, electrically insulating layer 11*c* is formed on the outer (upper) surface of the layer 11*b*. Another photoconductive layer 11*d* which is sensitive to red light and preferably light of at least one other color is formed on the outer (upper) surface of the layer 11*c*. The outer (upper) surface of the layer 11*d* constitutes the outer surface of the material 11.

The first step of the process as shown in FIG. 1*a*, is to radiate the outer surface of the material 11 with light which causes both photoconductive layers 11*b* and 11*d* to be rendered photoconductive. Simultaneously, a corona charger 12 applies a negative electrostatic charge to the outer surface of the material 11. White light serves the required function.

Since the layer 11*d* is rendered photoconductive the negative charge from the charger 12 migrates through the layer 11*d* and accumulates at the outer (upper) surface of the layer 11*c*. This accumlated negative charge causes positive charges to migrate from the substrate 11*a* through the layer 11*b* to the inner (lower) surface of the layer 11*c*. When the white illumination is terminated, the positive and negative charges are trapped at the lower and upper surfaces of the layer 11*c* as illustrated.

Figure 1B:
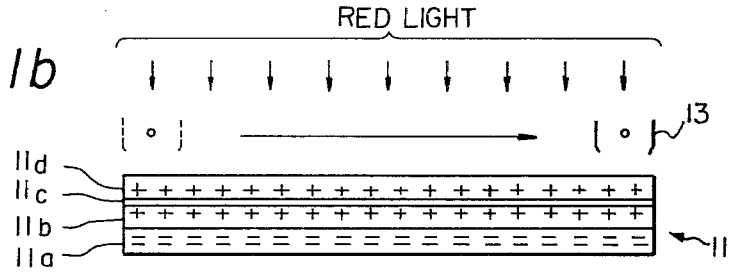

Next, the material 11 is radiated with light which renders only the layer 11*d* photoconductive. In this example, the function is fulfilled by red light. Simultaneously, a corona charger 13 applies a positive electrostatic charge to the outer surface of the material 11. This positive charge neutralizes the negative charge at the upper surface of the layer 11*c* and replaces the same with a positive charge. Since the layer 11*b* is not rendered photoconductive, there is no movement of charges therein. However, negative charges accumulate at the inner (lower) surface of the layer 11*b* to balance the positive charges in the layers 11*b* and 11*d*. This step is illustrated in FIG. 1*b*.

Figure 1C:
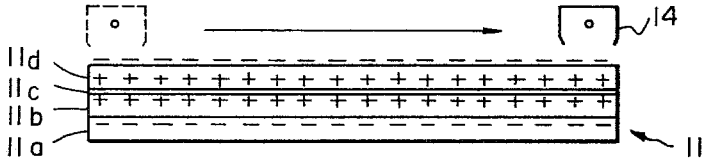

The next step, as illustrated in FIG. 1*c*, is to apply a negative charge to the outer surface of the material 11 in the dark using a corona charger 14. Since neither of the layers 11*b* and 11*d* conducts, there is no movement of charge therein. However, a negative charge is formed on the outer surface of the layer 11*d* and part of the negative charge at the inner surface of the layer 11*b* is dissipated. At the conclusion of this step, electrostatic charges of positive and negative polarity are formed at the outer surfaces of the layers 11*b* and 11*d* respectively.

Figure 1D:
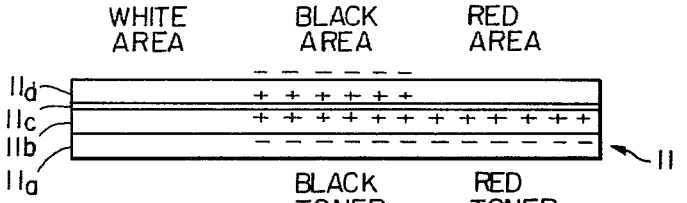

Then, as illustrated in FIG. 1*d*, a color light image of an original document (not shown) is radiated onto the outer surface of the material 11. It will be assumed that the light image has a white background area, a black area and a red area.

In the white area, both layers 11*b* and 11*d* are rendered photoconductive and all electrostatic charge is dissipated. The negative charge at the upper surface of the layer 11*d* and the positive charge at the upper surface of the layer 11*c* neutralize each other. The positive charge at the upper surface of the layer 11*b* dissipates into the layer 11*b* and substrate 11*a*. The electrostatic potential at the surface of the material 11 in the white area is zero.

In the black area there is no photoconduction in either of the layers 11*b* and 11*d*. Therefore, the surface electrostatic potential is dominated by the negative charge at the outer surface of the material 11 and is negative in polarity.

In the red area the layer 11*d* is rendered photoconductive and the charges in the layer 11*d* neutralize each other. The layer 11*b*, however, is not rendered photoconductive since it is not sensitive to red light. Thus, the positive charge remains at the upper surface of the layer 11*b*. This positive charge causes the electrostatic potential at the upper surface of the material 11 to be positive in the red area.

Figure 1E:
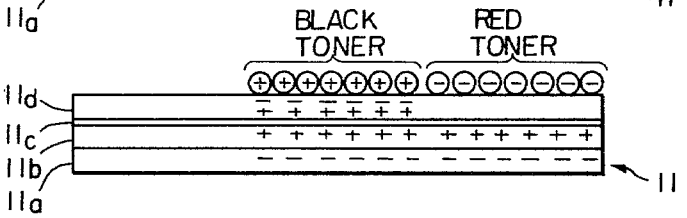

The final step of the process, as illustrated in FIG. 1*e*, is to apply two toner substances to the upper surface of the material 11. The toners may be applied either separately or as a mixture. One of the toners consists of black colored toner particles carrying a positive electrostatic charge. The other toner consists of red colored toner particles carrying a negative electrostatic charge.

The black toner particles, since they are positively charged, are attracted and adhere to the black image area of the material 11 which has a negative surface potential. The red toner particles, which are negatively charged, are attracted and adhere to the positive red image area of the material 11. The result is that a two color (black and red) toner image is formed on the material 11, with the red and black areas corresponding to the red and black areas of the light image. There is no adherence of toner to the white image areas which carry no electrostatic surface potential. Where the material 11 is formed directly on a white copy sheet, although not illustrated, the two color toner image is fixed to the material 11 and sheet by means of heat, pressure or a combination thereof. In this manner, the white areas of the image appear white on the finished copy due to the fact that the copy sheet is white.

Where the material is formed on a drum, belt or the like, it is transferred to a copy sheet and fixed thereto. Again, the copy sheet is white so that the white image areas appear white in the finished copy.

Numerous variations of the material 11 are possible within the scope of the present invention. For example, the layer 11*b* may be made sensitive to red light and may be identical to the layer 11*d*. In such a case, both photoconductive layers may be panchromatic. A filter means is provided between the layers 11*b* and 11*d* to prevent red light from reaching the layer 11*b* and rendering the same photoconductive. In other words, the filter means absorbs red light. The filter means may be in the form of separate layer provided between the layers 11*b* and 11*d*. Alternatively, coloring may be added to the layer 11*c* to absorb red light. As yet another alternative, either the layer 11*c* or a separate layer may be formed of a material to reflect red light back toward the layer 11*d*.

It is also possible to radiate white and/or red light onto the material 11 through the lower (inner) surface of the substrate 11*a*. Of course, the substrate 11*a* must be transparent to enable this modification to be operative.

Yet another modification is to form the layer 11*b* of a material such that charges, in this case holes, may be injected into the layer 11*b* from the substrate 11*a* without rendering the layer 11*b* photoconductive. This allows the step of FIG. 1*b* to be performed in the dark. A photoconductive material which exhibits this phenomenon is selenium.

The surface potential of the material 11 for the process of FIGS. 1*a* to 1*e* is illustrated in FIG. 5. This figure also applies qualitatively to the embodiments of FIGS. 2*a* to 2*e*, 3*a* to 3*e* and 4*a* to 4*e*.

FIGS. 2*a* to 2*e* illustrate the process of the present invention illustrated in FIGS. 1*a* to 1*e* as applied using another photoconductive material 16. The steps of FIGS. 2*a* to 2*e* correspond to the steps of FIGS. 1*a* to 1*e* respectively. The material 16 comprises a substrate 16*a*, photoconductive layer 16*b*, insulating layer 16*c* and photoconductive layer 16*d* which correspond to the layers described with reference to FIGS. 1*a* to 1*e*. The material 16 further comprises, however, another insulating layer 16*e* formed between the substrate 16*a* and layer 16*b*.

Figure 2A:
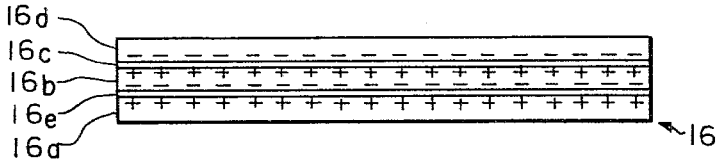
FIGS. 2*a* to 2*e* are diagrams illustrating another process and material of the invention.

In this case, the step of FIG. 2*a* causes positive and negative charges to be formed at the upper and lower surfaces of the layer 16*b*. In addition, positive charges migrate through the substrate 16*a* to the upper surface thereof due to the effect of the negative charge at the lower surface of the layer 16*b*.

Figure 2B:
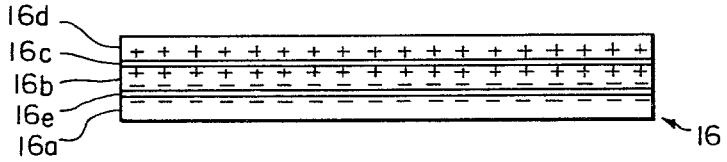

The step of FIG. 2*b* causes no change in the layer 11*b* but causes reversal of the charge at the lower surface of the layer 16*d*.

Figure 2C:
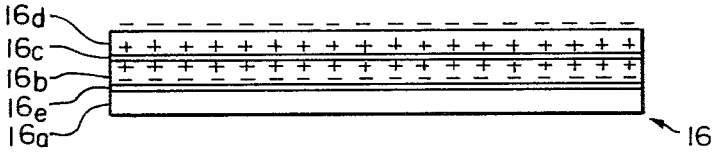
Figure 2D:
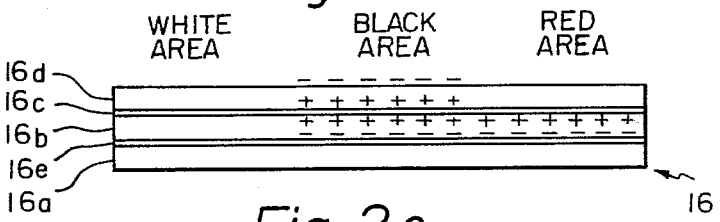
Figure 2E:
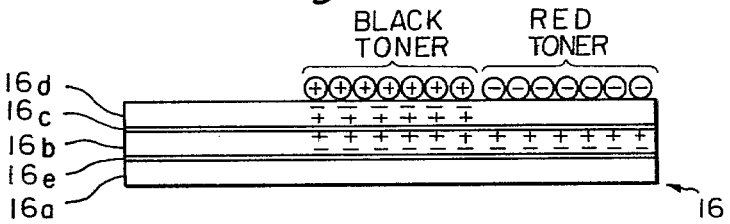

The step of FIG. 2*c* is quite similar to step of FIG. 1*c*. The step of FIG. 2*d* is also similar to the step of FIG. 1*d*. The main difference is that at the conclusion of the step of FIG. 2*d* there is a negative charge at the lower surface of the layer 16*b* which somewhat increases the negative surface potential in the black area and reduces the positive surface potential in the red area. However, the positive and negative surface potentials in the red and black areas may be made substantially equal in magnitude through proper selection of the magnitudes of the electrostatic charges in the steps of FIGS. 2*a* to 2*c*.

FIGS. 3*a* to 3*e* illustrate another material 17 and process of the present invention. While the process steps are the same as in FIGS. 1*a* to 1*e*, the material 17 comprises, in addition to a substrate 17*a*, first photoconductive layer 17*b*, transparent insulating layer 17*c* and second photoconductive layer 17*d*, a second transparent insulating layer 17*e* formed at the outer (upper) surface of the layer 17*d* and thereby the material 17.

Figure 3A:
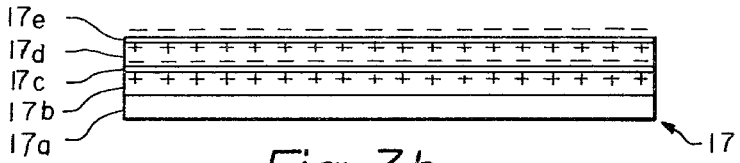
FIGS. 3*a* to 3*e* are diagrams illustrating another process and material of the invention.
Figure 3B:
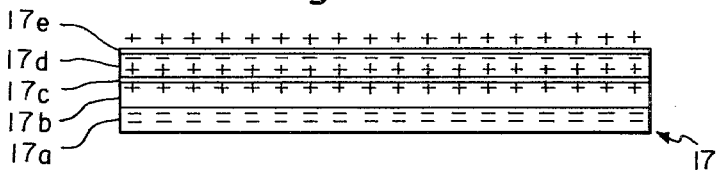
Figure 3C:
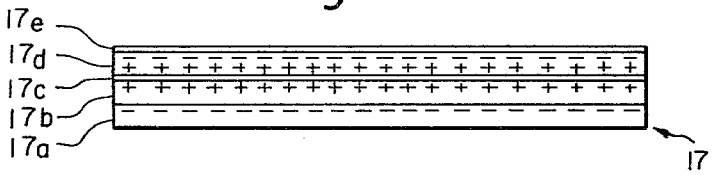
Figure 3D:
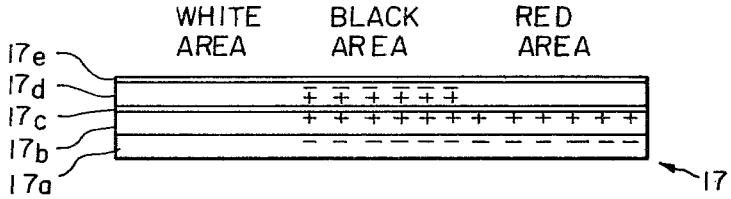
Figure 3E:
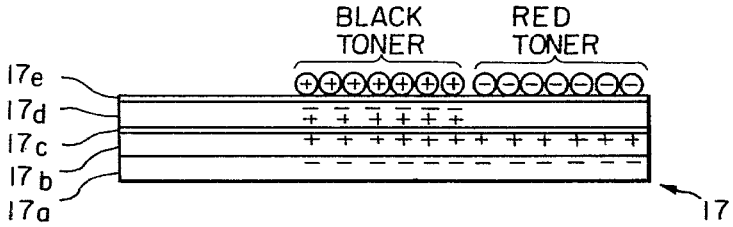

In the step of FIG. 3*a*, negative charges are formed at the upper surfaces of both insulating layers 17*c* and 17*e* and positive charges are formed at the lower surfaces thereof. The step of FIG. 3*b*, during which only the layer 17*d* conducts, causes charge reversal in the layer 17*d* and at the upper surface of the layer 17*e*. The step of FIG. 3*c* functions to remove the charge from the upper surface of the layer 17*e*. The result is identical to the step of FIG. 1*c* except for the presence of the layer 17*e*. The steps of FIGS. 3*d* and 3*e* produce the same results as the steps of FIGS. 1*d* and 1*e*.

Figure 4A:
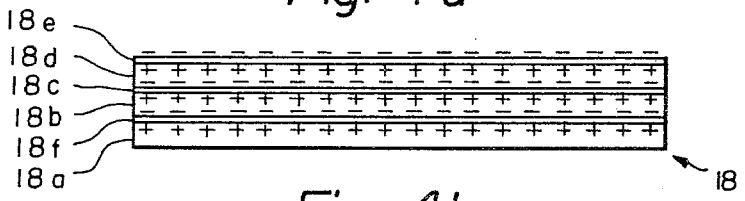
FIGS. 4*a* to 4*e* are diagrams illustrating another process and material of the invention.
Figure 4B:
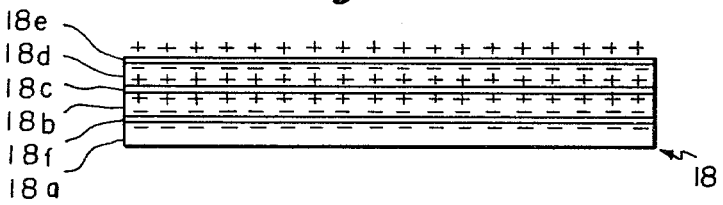
Figure 4C:
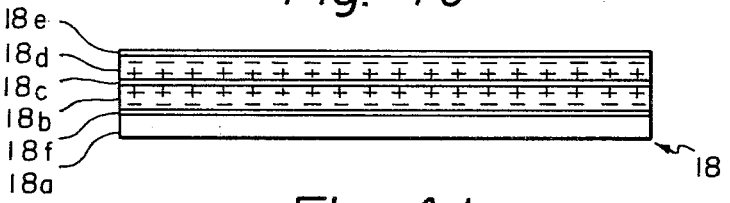
Figure 4D:
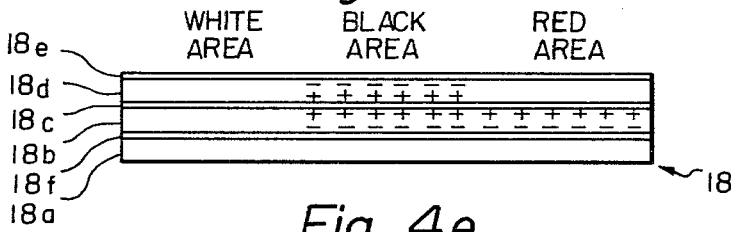
Figure 4E:
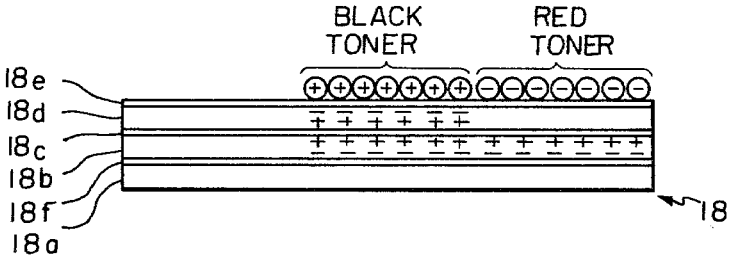

The process of FIGS. 4*a* and 4*e* is essentially a combination of the modifications of FIGS. 2*a* to 2*e* and 3*a* to 3*e*. A material 18 comprises a substrate 18*a*, first photoconductive layer 18*b*, first insulating layer 18*c*, second photoconductive layer 18*d*, third transparent insulating layer 18*e* formed at the outer surface of the material 18 and third insulating layer 18*f* formed between the substrate 18*a* and first photoconductive layer 18*b*.

The step of FIG. 4*a* causes formation of negative charge at the upper surfaces of the insulating layers 18*e*, 18*c* and 18*f* and positive charges at the lower surfaces thereof. The step of FIG. 4*b* causes charge reversal in the layer 18*d* and at the upper surface of the layer 18*e*. The step of FIG. 4*c* causes removal of charge from the upper (outer) surface of the layer 18*e*. As in the previous cases, the conclusion of the third step results in charges of opposite polarities being formed on the outer surfaces of the two photoconductive layers respectively. It will be noted that the charge removal of the step of FIG. 4*c* may be performed using A.C. corona discharge (alternating electrostatic charge) or contact with a conductive liquid.

The step of FIG. 4*d* causes dissipation of charge in the layer 18*d*. Thus, in the black area the negative charge at the upper surface of the layer 18*d* causes a net negative surface potential while the positive charge at the upper surface of the layer 18*b* in the red area causes a net positive surface potential.

An electrostatic copying machine for performing the processes described thus far is shown in FIG. 6, generally designated by the reference numeral 21 and comprises a drum 22 which is rotated counterclockwise at constant speed. Either of the materials 11, 16, 17 or 18 is formed on the periphery of the drum 22 although not specifically illustrated.

Assuming the process of FIGS. 1*a* to 1*e*, the step of FIG. 1*a* is performed by means of a white light source 23 which radiates the surface of the drum 22 with white light while the drum 22 is charged to a negative polarity by the corona charging unit 12. Downstream of the charging unit 12 is provided the corona charging unit 13 which applies a positive charge to the drum 22. The light from the light source 23 is passed through a red filter 26 and radiated onto the drum 22 at the same position as the electrostatic charge is applied from the charging unit 13 to constitute the step of FIG. 1*b*. Then, a negative charge is applied to the drum 22 by the corona charging unit 14 to constitute the step of FIG. 1*c*.

The drum 22 thus charged is further rotated to an imaging position where an optical system symbolically illustrated as being in the form of a converging lens 29 focuses a light image of an original document 31 onto the drum 22. The document 31 is assumed to have printing thereon in at least red and black on a white background. This imaging operation constitutes the step of FIG. 1*d*.

The step of FIG. 1*e* is performed in two stages by a developing unit 32 which applies positively charged black toner to the drum 22 and a developing unit 33 which applies negatively charged red toner to the drum 22. A precharger 34 then applies a positive or negative charge to the toner image on the drum 22 to convert all toner particles to the same polarity. A sheet of white copy paper 36 is passed in contact with the drum 22 at the same surface speed thereas while a transfer charger 37 applies an electrostatic charge of a polarity opposite to the polarity of the precharger 34 to the back of the paper 36. This causes the two color toner image to be transferred from the drum 22 to the paper 36. Then, although not shown, a fixing unit fixes the toner image to the paper 36. Similarly not illustrated are means for discharging the drum 22 and removing residual toner therefrom.

It will be noted that the toners do not have to be red and black. They can be of any two different colors. It is not necessary that the two color copy be a faithful color reproduction of the original document 31 but only that the two colors be distinguishable from each other. It is also necessary to understand that charge injection rather than photoconduction is not operable using the materials 16 and 18 due to the presence of the insulating layers 16*e* and 18*f* respectively.

The following experiments constitute examples of the process and material of the present invention.

EXAMPLE 1

One part acrylic resin was mixed with two parts zinc oxide and sensitized with rose bengale. The resulting substance was deposited on an aluminum drum to a thickness of 20 microns to from an inner photoconductive layer. A polyester film marketed by the Torei Co. Ltd. of Japan under the tradename LUMIRROR was formed to a thickness of 4 microns on the inner photoconductive layer to constitute a transparent insulating layer. An organic photoconductor marketed as PVCz-TNF was formed on the insulating layer to a thickness of 10 microns to constitute an outer photoconductive layer.

The thus prepared drum was illuminated with white light while being charged to a surface potential of +600 V by a corona charging unit. The discharge voltage of the charging unit was +5.5 KV. Then, the drum was illuminated with white light passed through a filter which absorbs all wavelengths above 600 nm. The drum was charged to a surface potential of −800 V by a corona charging unit at a discharge voltage of −6.5 KV. A third charge was applied to the drum by a corona charging unit at a discharge voltage of +6.5 KV, resulting in a surface potential of +600 V.

A light image of a document having white, red and black image areas was focussed onto the drum at an irradiance of 180 $\mu W/cm^2$ for 1/15 sec. The resulting surface potential was −60 V in the white image areas, +560 V in the black image areas and −460 V in the red image areas. The electrostatic image was developed using a negatively charged black toner and a positively charged red toner applied by magnetic brush developing units. The toner image was precharged to a positive polarity and transferred to a sheet of copy paper. After fixing, the two color copy exhibited extremely clear red and black areas. The resolution in the black areas was as high as 7 lines/mm. The drum was discharged and cleaned prior to subsequent use. It will be noted that the charge polarities in this example are opposite to those illustrated in the drawings described thus far.

EXAMPLE 2

The experiment of example 1 was repeated with the differences that the inner photoconductive layer was formed of vacuum evaporated selenium to a thickness of 50 microns rather than zinc oxide. In addition, the polarities of charge were reversed from example 1. The experiment of example 2 produced excellent results comparable to example 1.

EXAMPLE 3

Example 1 was repeated with the difference that the outer photoconductive layer was formed of bromopyrene sensitized with tetranitrofluorenon instead of PVCz-TNF. The results of this experiment were also excellent.

EXAMPLE 4

Example 2 was repeated with the difference that the outer photoconductive layer was formed of bromopyrene sensitized with tetranitrofluorenon instead of PVCz-TNF. The results of this experiment were also excellent.

EXAMPLES 5 AND 6

Examples 2 and 4 were repeated with the difference that the inner photoconductive layer was formed of selenium sensitized with 10% tellurium by weight and had a panchromatic sensitivity. The insulating layer was formed of a material which absorbs red light. The results were similarly excellent.

EXAMPLE 7

Example 2 was repeated with the difference that the inner photoconductive layer was formed of the tellurium sensitized selenium layer used in examples 5 and 6 and the outer photoconductive layer was formed of copper phthalocyanine. This experiment produced the same excellent results as example 2. Although the insulating layer was transparent to red light, the inner photoconductive layer was not rendered photoconductive upon radiation of red light, apparently because the red light was absorbed by the copper phthalocyanine outer layer.

EXAMPLES 8 TO 14

Examples 1 to 7 were repeated with the difference that a polyester film layer having a thickness of 4 microns and being electrically insulative was provided between the drum and the inner photoconductive layer. The results were similarly excellent.

EXAMPLES 15 TO 28

Examples 1 to 14 were repeated with the difference that a 4 micron insulating film of polyester was formed on the outer surface of the outer photoconductive layer. The results were similarly excellent. It was also determined that the same results could be obtained where the discharge voltage of the third corona charging unit consisted of an A.C. discharge of 6.0 KV rms superimposed on a D.C. bias level of +1.0 KV or −0.8 KV.

FIGS. 7*a* to 7*e* illustrate another process and material of the present invention which differ from those described heretofore. A material 41 is generally similar to the material 17 and comprises a conductive substrate 41*a*, an inner photoconductive layer 41*b* insensitive to red light, a transparent insulating layer 41*c*, a second photoconductive layer 41*d* sensitive to red light and an outer transparent insulating layer 41*e*.

Figure 7A:
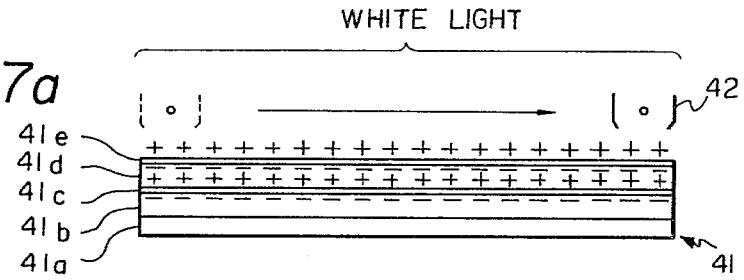
FIGS. 7*a* to 7*e* are diagrams illustrating another process and material of the invention.
Figure 7B:
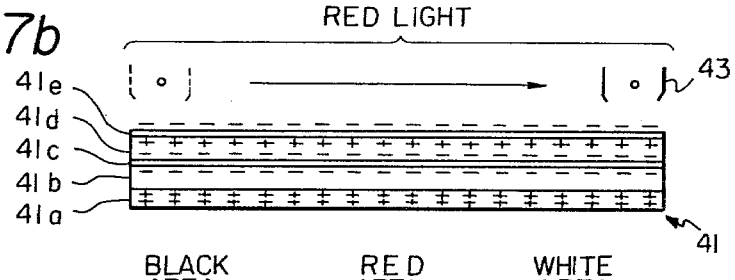

In the first step of FIG. 7*a*, white light is radiated onto the outer surface of the material 41 while a positive electrostatic charge is applied by a corona charging unit 42. This causes positive charges to be formed at the upper surfaces of the layers 41*c* and 41*e* and negative charges to be formed at the lower surfaces thereof since both layers 41*b* and 41*d* are rendered photoconductive. In the next step of FIG. 7*b* a negative charge is applied to the material 41 by a charging unit 43 while the material 41 is radiated with red light. This causes only the layer 41*d* to be rendered photoconductive and causes reversal of charge in the layer 41*d* and at the outer surface of the layer 41*e*.

Figure 7C:
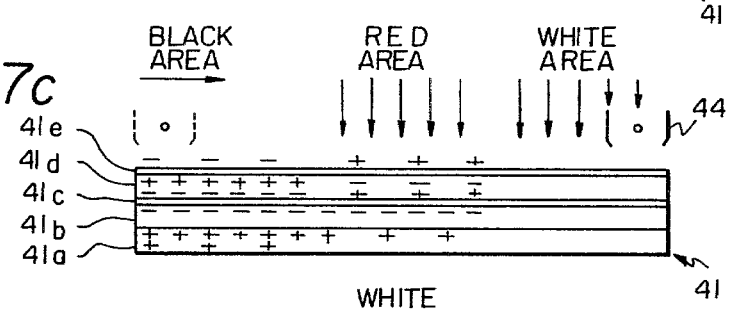

In the third step of FIG. 7*c*, a color light image is radiated onto the material 41. Simultaneously, the surface potential of the material 41 is reduced to substantially zero by a corona charging unit 44 which applies a positive charge to the material 41. The voltage applied to the charging unit 44 is designed to exactly neutralize the charges applied by the units 42 and 43.

In the white image areas both layers 41*b* and 41*d* conduct dissipating all charge. In the red image areas only the layer 41*d* conducts. The negative charge at the upper surface of the layer 41*b* causes positive and negative charges to be formed at the lower and upper surfaces of the layer 41*d* respectively. The negative charge at the upper surface of the layer 41*d* attracts the charge of the charging unit 44 so that the applied positive charge overcomes the existing negative charge and produces a net positive charge on the outer surface of the layer 41*e*.

In the black image areas there is no photoconduction. The positive charge at the upper surface of the layer 41*d* repels the positive charge applied by the charging unit 44 so that although part of the negative charge on the upper surface of the layer 41*e* is neutralized, some negative charge remains. It is important to understand that although negative and positive charges exist on the upper surface of the layer 41*e* at the conclusion of the step of FIG. 7*c*, the electrostatic potential at the upper surface of the layer 41*e* is zero due to the effect of mirror image charges formed at the lower surface of the layer 41*b* and charges in the layers 41*b* and 41*d*.

Figure 7D:
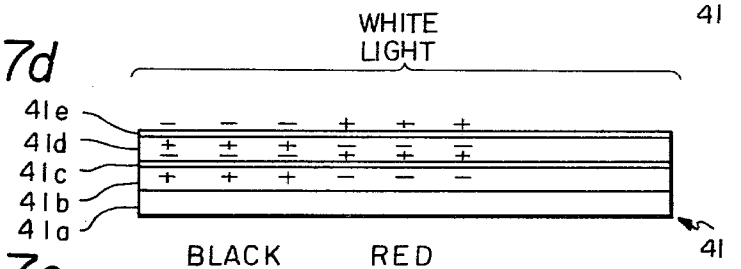
Figure 7E:
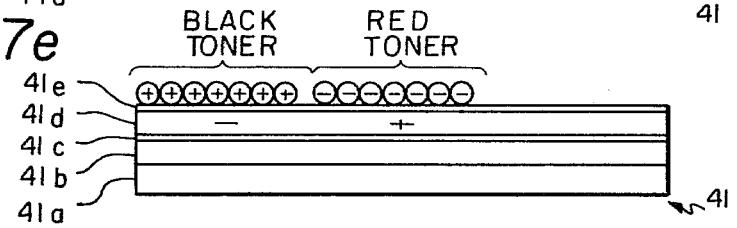

The fourth step of the process is shown in FIG. 7*d* and consists of radiating the material 41 with white light. This causes both layers 41*b* and 41*d* to conduct. The negative charge on the upper surface of the layer 41*e* in the black image areas causes a positive mirror image charge to be formed at the lower surface of the layer 41*c* and positive and negative charges to be formed at the upper and lower surfaces of the layer 41*d* respectively. In the red image areas the positive charge at the upper surface of the layer 41*e* causes exactly the opposite charge distribution. The net effect is that the electrostatic surface potential on the outer surface of the layer 41*e* and thereby the material 41 is negative in the black image areas, positive in the red image areas and zero in the white image areas. The final step of FIG. 7*e* consists of developing the electrostatic image using positively charged black toner and negatively charged red toner. The electrostatic surface potential is illustrated in FIG. 9.

FIGS. 8*a* to 8*e* illustrate a process generally comprising the same steps as the process of FIGS. 7*a* to 7*e*. The material 41 is replaced by a material 46 in which the substrate 41*a* is replaced by an insulating layer 46*a*. The material 46 comprises a photoconductive layer 46*b*, insulating layer 46*c*, photoconductive layer 46*d* and insulating layer 46*e* which correspond to the material 41.

Due to the absence of a substrate, a mirror image charge on the lower surface of the material 46 cannot be formed by charge migration through the substrate. To overcome this problem a charging unit 48 applies a negative charge to the lower surface of the material 46 while a charger 47 applies a positive charge to the upper surface of the material 46 in the step of FIG. 8*a*.

Figure 8A:
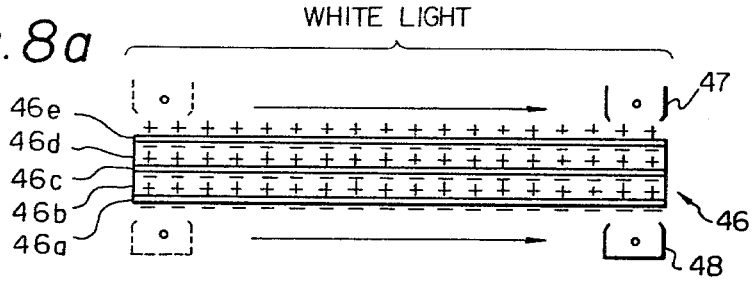
FIGS. 8*a* to 8*e* are diagrams illustrating another process and material of the invention.
Figure 8B:
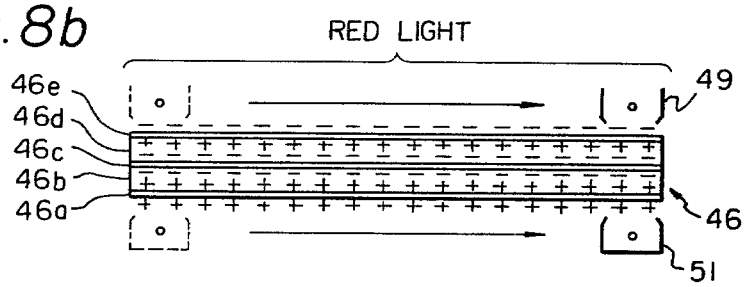
Figure 8C:
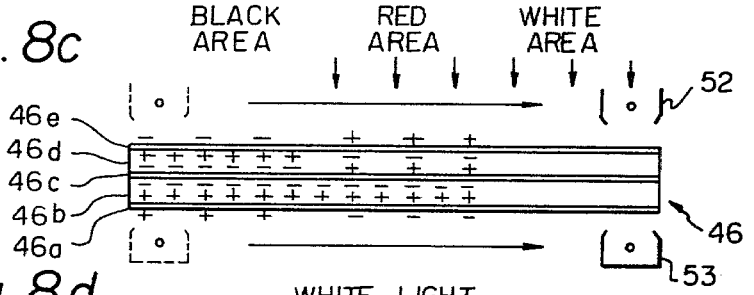
Figure 8D:
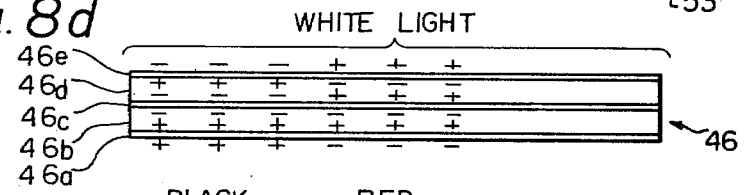
Figure 8E:
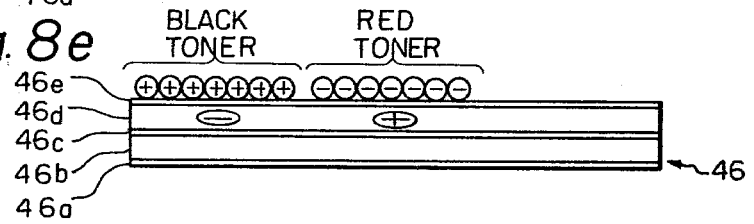

In the step of FIG. 8*b* a charging unit 49 applies a negative charge to the upper surface of the material 46 while a charging unit 51 applies a positive charge to the lower surface of the material 46. In the step of FIG. 8*c* a charging unit 52 applies a positive charge to the upper surface of the material 46 while a charging unit 53 applies a negative charge to the lower surface of the material 46. The result is basically similar to the process of FIGS. 7*a* to 7*e*.

The step of FIG. 7*c* or 8*c* may be performed using A.C. corona discharge or contact with an electrically conductive liquid.

FIG. 10 illustrates an apparatus 61 for performing the process of FIGS. 7*a* to 7*e* and comprises a drum 62 which is rotated counterclockwise at constant speed. The material 41 is formed on the surface of the drum 62.

The charging unit 42 applies a positive charge to the drum 62 while a white light source 63 illuminates the drum 62. The light from the source 63 is passed through a red filter 64 onto the drum 62 downstream of the position of the charging unit 42. The charging unit 43 applies a negative charge to the drum 62 at the same position as the red light illumination. A color light image of a document 66 is focussed by a converging lens 67 onto the drum 62 while the same portion of the drum 62 is positively charged by the charging unit 44. A light source 68 then illuminates the drum 62 with white light. Developing units 69 and 71 apply positively charged black toner and negatively charged red toner respectively to the drum 62. A precharger 72 all of the toner to the same polarity. The toner image is transferred to a copy sheet 73 by a transfer charging unit 74. A cleaning unit 76 discharges and cleans the drum 62.

Figure 11:
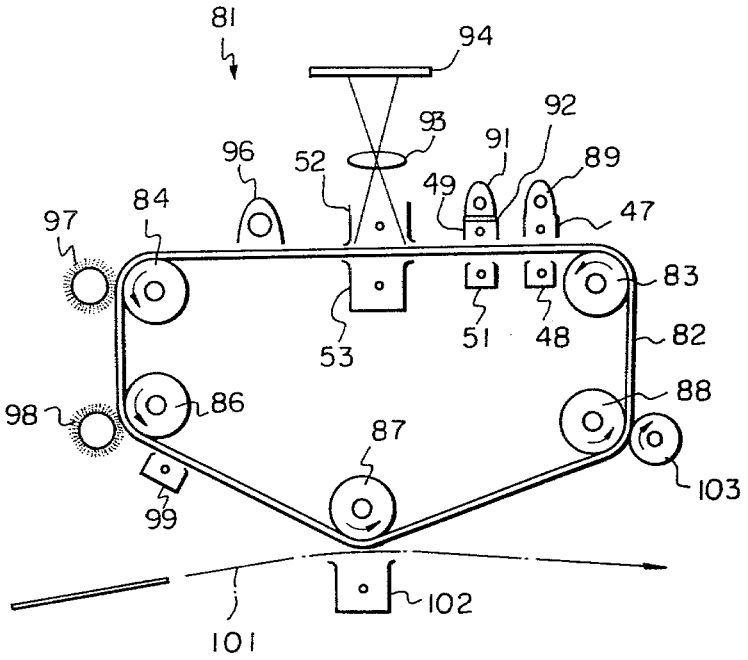
FIG. 11 is a schematic diagram of an apparatus for performing the process of FIGS. 8*a* to 8*e*.

An apparatus 81 for performing the process of FIGS. 8*a* to 8*e* is shown in FIG. 11 and comprises an endless belt 82 which is rotated counterclockwise at constant speed. The belt 82 is made of the material 46 with the layer 86*a* facing inwardly and the layer 46*e* facing outwardly. The belt 82 is trained around rollers 83, 84, 86, 87 and 88.

The charging units 47 and 48 apply positive and negative charges respectively to the outer and inner surfaces of the belt 82 while the belt 82 is illuminated by a white light source 89. Then, the charging units 49 and 51 apply negative and positive charges respectively to the outer and inner surfaces of the belt 82 while red light is radiated onto the belt 82 by means of a white light source 91 and a red filter 92.

Positive and negative charges are applied to the outer and inner surfaces of the belt 82 by the charging units 52 and 53 respectively while a converging lens 93 radiates a light image of a colored codument 94 onto the belt 82. A white light source 96 then illuminates the belt 82.

Developing units 97 and 98 apply positively charged black toner and negatively charged red toner respectively to the belt 82 to form a two color toner image. A precharger 99 converts all of the toner to the same polarity. The toner image is transferred to a copy sheet 101 by a transfer charger 102. A cleaning unit 103 discharges and cleans the belt 82.

The following experiments were performed which constitute examples of the processes of FIGS. 7*a* to 7*e* and 8*a* to 8*e*.

EXAMPLE 1

An inner photoconductive layer was formed of zinc oxide resin sensitized with rose bengale on a graphite substrate. This layer was insensitive to light of a wavelength higher than 600 nm, which includes red light. A 4 micron thick film made of a polyester resin marketed under the tradename LUMIRROR by the Torei Co. Ltd. of Japan was formed on the inner photoconductive layer to constitute a transparent insulating layer. An outer photoconductive layer made of an organic photoconductor PVCz-TNF, 12 microns thick, was formed on the insulating layer. This outer photoconductive layer had a panchromatic sensitivity. Then, a 12 micron thick polyester film layer was formed on the outer photoconductive layer to constitute another transparent insulating layer. The material thus prepared corresponds in structure to the material 41.

The material was charged to a surface potential of +900 V while being illuminated with white light. Then, the material was illuminated with red light and charged to a surface potential of −1200 V. The red light was obtained by means of a white light source and a Toshiba VR-64 filter. Then, the surface potential of the material was removed by means of an A.C. corona discharge of 6000 Vrms while a colored light image was radiated onto the material. Then, the material was illuminated with white light. The resulting surface potential was −50 V in the white areas, −400 V in the black areas and +280 V in the red areas.

The resulting bipolar electrostatic image was developed using magnetic brush developing units which applied a positively charged black toner marketed as Konishiroku U-Bix 480 and a negatively charged red toner which was an experimental produce of the Ricoh Co., Ltd.

The two color toner image was precharged to a positive polarity transferred to a copy sheet and fixed thereto by heat. The resulting copy had excellent red and black color areas on a clean white background and high resolution.

EXAMPLE 2

The experiment of example 1 was repeated with the differences that the inner photoconductive layer was replaced by a selenium layer sensitized with tellurium and the inner insulating layer was replaced with a 2 to 3 micron thick layer of silicone containing a cyanic pigment. In addition, the polarities of the charges were reversed. This experiment produced similarly excellent results.

EXAMPLE 3

Example 2 was repeated with the differences that the inner insulating layer was formed of pure silicone and the outer photoconductive layer was formed of copper phthalocyanine. The results were excellent. Since red light was absorbed by the copper phthalocyanine layer the selenium layer was not rendered conductive even though the outer surface of the material was illuminated with red light.

EXAMPLE 4

A four layer photoconductive material was prepared by omitting the silicone layer from the material of example 3. The process of example 3 was repeated with the difference that the first charge was applied while the material was radiated with red light. The resulting copy density was only about 50% to 60% that of example 3, although resolution was good.

EXAMPLE 5

A six layer photoconductive material was prepared by adding a 4 micron thick layer between the substrate and the inner photoconductive layer of example 1. The process of example 1 was repeated using the modified material and produced similarly excellent results. It was determined that this modification greatly increased the service life of the inner photoconductive layer and therefore the service life of the material. The modified material produced about 50,000 acceptable copies as compared to 2,000 with the material of example 1.

EXAMPLE 6

Examples 1 to 3 were repeated using a transparent substrate rather than the opaque graphite substrate and exposure and radiation of the light image onto the materials was performed through the substrate. The results were excellent.

EXAMPLE 7

Example 1 was repeated with the difference that, during radiation of the light image onto the material, the surface potential was reduced to zero by means of immersion in an electrically conductive liquid rather than electrostatic charging. The liquid used was ethyl alcohol. This method produced excellent results comparable to the other examples.

EXAMPLE 8

Example 1 was repeated with the difference that removal of charge was effected using a D.C. corona discharge of +4.7 KV rather than A.C. corona discharge. The results were excellent.

It will be understood that the insulating layer provided between the two photoconductive layers is not always necessary and that the process may be performed using a 4, 5 or 6 layer photoconductive material as described and illustrated. It is possible to remove charge during the third process step using A.C. or D.C. corona discharge or electrical conduction with liquid. The uniform light radiation and/or imagine exposure may be performed from either side of the material if the substrate and appropriate insulating layers are made transparent.

Another process and material of the present invention are illustrated in FIGS. 12*a* to 12*e*. A photoconductive material 121 comprises a conductive substrate 121*a*, an inner photoconductive layer 121*b* formed on the substrate 121*a*, a second photoconductive layer 121*c* formed on the layer 121*b* and a transparent insulating layer 121*d* formed on the layer 121*c*.

The material 121 differs from the materials described heretofore in that the layer 121*b* is insensitive to red light and the layer 121*c* is insensitive to blue light.

Figure 12A:
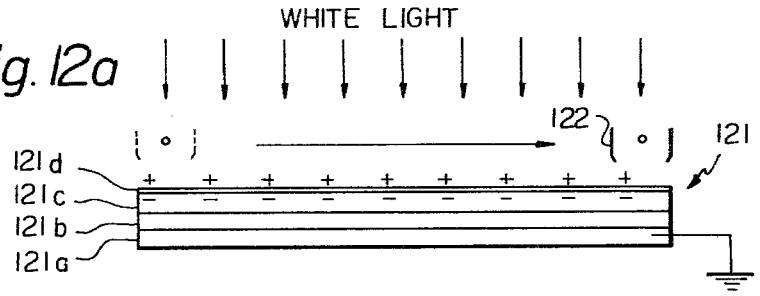
FIGS. 12*a* to 12*e* are diagrams illustrating another process and material of the invention.
Figure 12B:
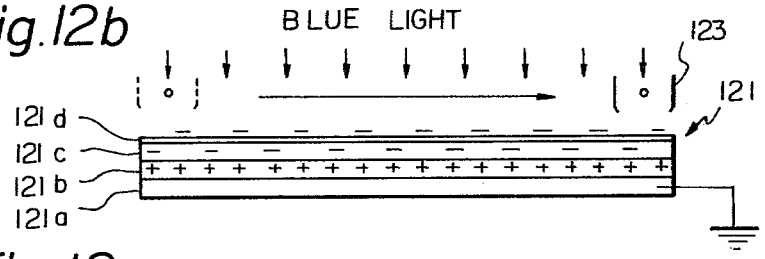

In the first step of the process, illustrated in FIG. 12*a*, the material 121 is radiated with white light while being charged to a positive polarity by a corona charging unit 122. Both layers 121*b* and 121*c* are rendered photoconductive and positive and negative charges are formed at the upper and lower surfaces of the layer 121*d*.

In the second step of FIG. 121*b*, a charger 123 applies a negative charge to the material 121 while the material 121 is illuminated with blue light. This renders only the layer 121*b* photoconductive. The positive charge at the upper surface of the layer 121*d* is neutralized and replaced with a negative charge. A positive charge is formed at the upper surface of the layer 121*b*.

Figure 12C:
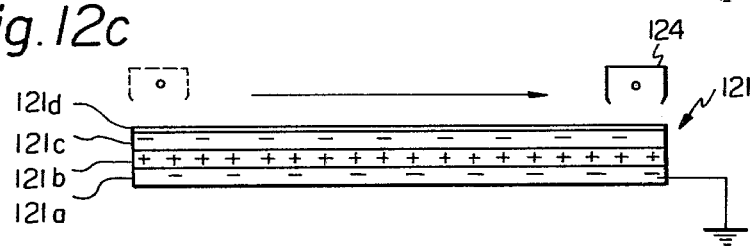
Figure 12D:
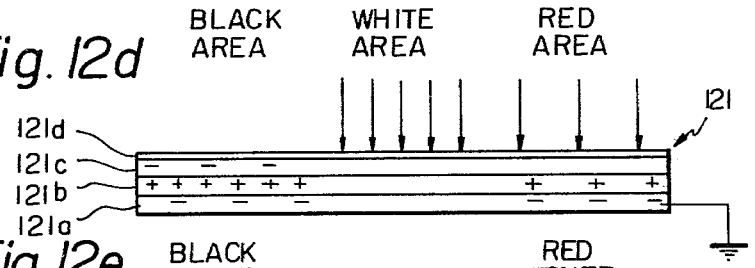

The third step of FIG. 12*c* is to remove charge from the upper surface of the layer 121*d* by means of a corona charging unit 124 which applies a positive charge. This step is performed in the dark.

In the next step of FIG. 121*d* a color light image is radiated onto the material 121. In the white areas both layers 12*b* and 12*c* conduct and all charge is dissipated.

In the black areas there is no conduction and the negative charges at the upper surface of the layer 12*c* produce a net negative surface potential on the material 121.

In the red areas only the layer 121*c* conducts. The positive charge at the upper surface of the layer 121*b* causes the surface potential of the material 121 to be positive.

Figure 12E:
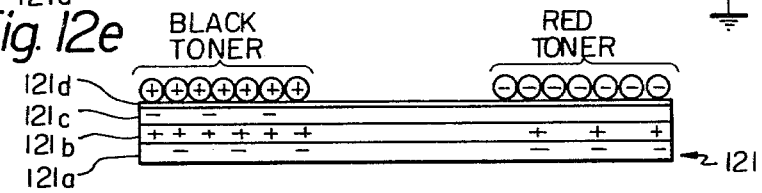
Figure 13:
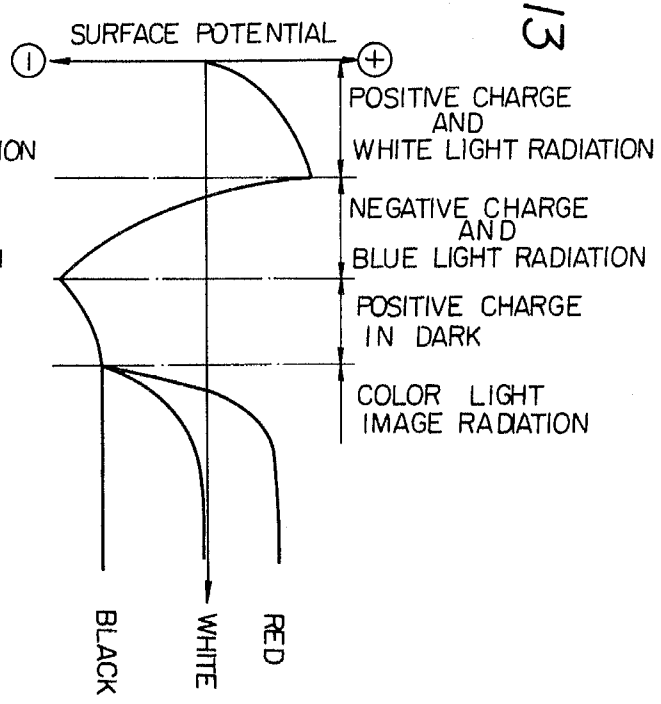
FIG. 13 is a graph illustrating the operation of the process of FIGS. 12*a* to 12*e*.

The bipolar electrostatic image is developed using positively charged black toner and negatively charged red toner as shown in FIG. 12*e*. The surface potential of the material 121 is illustrated in FIG. 13.

FIGS. 14*a* to 14*e* show process comprising the same general steps as the process of FIGS. 12*a* to 12*e* but using a different material. A photoconductive material 126 comprises a conductive substrate 126*a*, an inner photoconductive layer 126*b* which is sensitive to red light, an outer photoconductive layer 126*c* which is insensitive to red light and an insulating layer 126*d*.

Figure 14A:
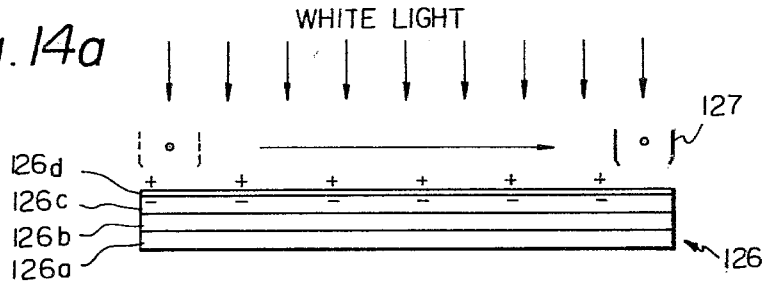
FIGS. 14*a* to 14*e* are diagrams illustrating another process and material of the invention.

In the first step of FIG. 14*a* the material 126 is radiated with white light and positively charged by a corona charging unit 127. This results in the formation of a positive charge at the upper surface of the layer 126*d* and a negative charge at the lower surface thereof since both layers 126*b* and 126*c* are rendered photoconductive.

Figure 14B:
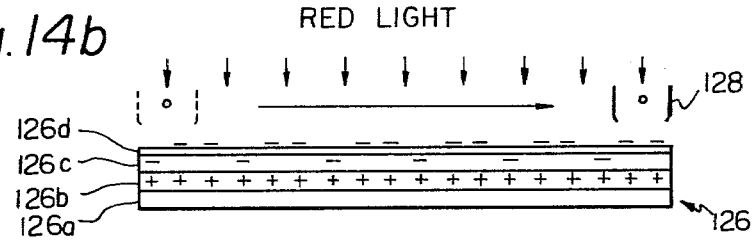

In the step of FIG. 14*b* the material 126 is radiated with red light and negatively charged by a corona charging unit 128. Only the layer 126*b* is rendered photoconductive and a positive charge is formed at the upper surface thereof. The charge on the upper surface of the material 126 is negative.

Figure 14C:
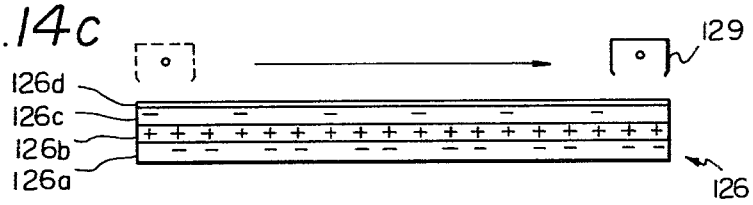

In the step of FIG. 14*c* a positive charge is applied to the material 126 in the dark by a corona charging unit 129 which removes the charge from the upper surface of the material 126.

Figure 14D:
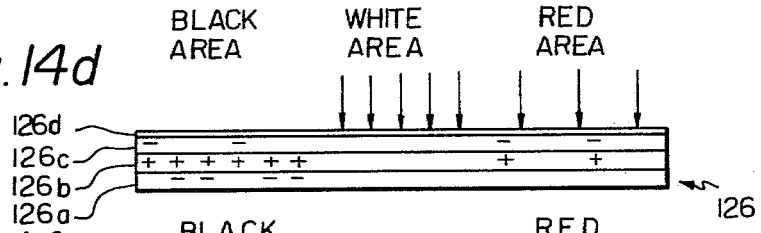

In the step of FIG. 14*d* a color light image is radiated onto the material 126. Both layers 126*b* and 126*c* conduct in the white areas and all charge is dissipated.

The magnitude of the charge of step 14*b* is selected to be much greater than the magnitude of the charge of the step of FIG. 14*a*. In the black image areas there is no conduction. However, the large positive charge at the upper surface of the layer 126*b* predominates over the small negative charge at the upper surface of the layer 126*c* so that the surface potential of the material 126 is positive in the black image areas.

In the red image areas only the layer 126*b* conducts and the negative charge at the upper surface of the layer 126*c* causes the surface potential of the material 126 to be negative in the red areas.

Figure 15:
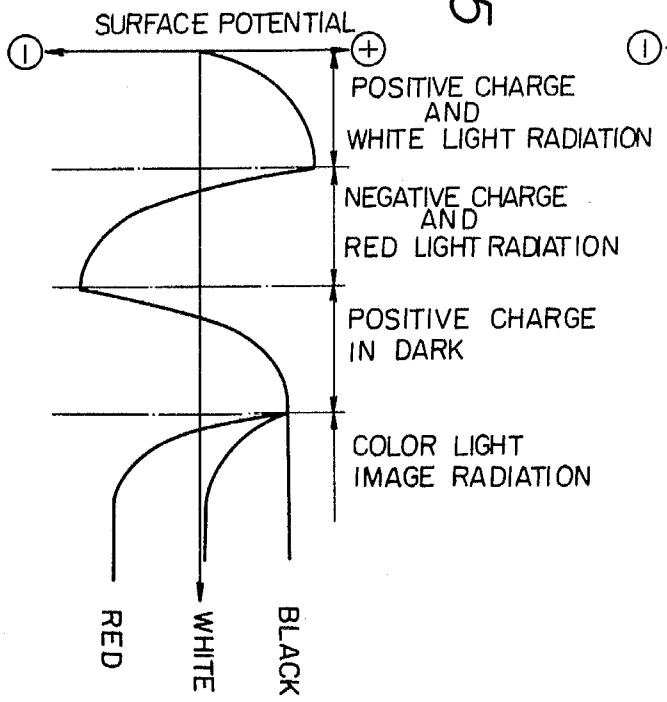
FIG. 15 is a graph illustrating the operation of the process of FIGS. 14*a* to 14*e*.
Figure 14E:
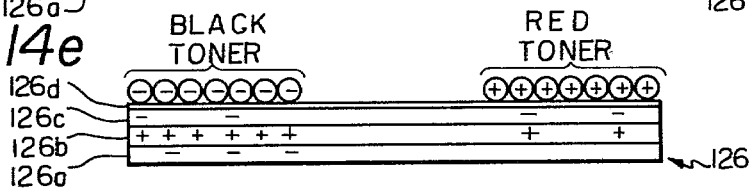

The resulting bipolar electrostatic image is developed using a negatively charged black toner and a positively charged red toner as illustrated in FIG. 14*e*. It will be noted that the toner polarities of the process of FIGS. 14*a* to 14*e* and opposite to the toner polarities of the process of FIGS. 12*a* to 12*e*. The main differences between these processes are the different spectral sensitivities of the photoconductive layers, the magnitudes of the applied charges and the polarities of the toners. The surface potential for the process of FIGS. 14*a* to 14*e* is illustrated in FIG. 15.

The following experiments constitute examples of the process of FIGS. 12*a* to 12*e* and 14*a* to 14*e*.

EXAMPLE 1

Selenium of a purity of 99.99% was vacuum deposited on an aluminum substrate to a thickness of 10 microns at a temperature of 50° C. and a vacuum of $5\times10^{-5}$ Torr to constitute an inner photoconductive layer. This material was stored in the dark for one week. Then, a 20 micron thick layer of polyvinyl carbozol trinitrofluorenon PVK-TNF was formed on the selenium layer to constitute a second photoconductive layer. Finally, a 5 micron thick layer of U-POLYMER, a tradename of a material manufactured by the Asahi Kasei Co. Ltd. of Japan was formed on the second photoconductive layer to constitute an insulating layer.

The selenium layer was insensitive to red light while the PVK-TNF layer panchromatic. The material generally corresponds to the material 121. However, the second charge may be performed in the dark by means of charge injection rather than photoconduction due to the properties of the selenium layer. The U-POLYMER had a volume resistivity of $10^{16}$ Ωcm and excellent mechanical strength.

This material was charged to a surface potential of +900 V by means of a +5.5 KV corona discharge while being radiated with white light. Then, the material was charged in the dark using −6.0 KV corona discharge. Then, the charge on the surface of the material was removed using a +4.5 KV corona discharge. The surface potential was −600 V after the second charge and −400 V after the third charge.

Then, a color light image was radiated onto the material. The surface potential in the white areas was −20 V. The surface potential in the black areas was −380 V. The surface potential in the red areas was +220 V. The image light intensity in the white areas was 10 $\mu W/cm^2$.

The bipolar electrostatic image was developed using a positively charged black toner and a negatively charged red toner. The resulting copy had excellent color and resolution.

The material of example 1 was formed on a drum and subjected to an endurance test. The resulting photoconductive drum was installed in an electrostatic copying machine of the image transfer type which comprises magnetic brush developing units and rubber blade drum cleaning system. The drum was able to produce 50,000 usable copies. The production cost, exclusive of the cost of manufacturing the aluminum drum itself, was estimated at $65.00 to $80.00 on a production scale of 1,000 units per month.

EXAMPLE 2

A selenium tellurium alloy having a tellurium content of 5% by weight was vacuum deposited on an aluminum substrate to a thickness of 50 microns at a temprature of 74° C. to form an inner photoconductive layer. A 15 micron thick zinc oxide resin layer sensitized with rose bengale was formed on the inner layer to form an outer photoconductive layer. The ratio of zinc oxide to resin was 3:1 by weight. Then, a 5 micron thick polyester resin layer was formed on the outer photoconductive layer to form an insulating layer. The material corresponds generally to the material 126. The zinc oxide resin layer was insensitive to red light. The selenium tellurium layer was panchromatic.

The material of example 2 produced excellent results using the process of FIGS. 14*a* to 14*e*.

FIGS. 16*a* to 16*e* illustrate another process and material of the present invention. A material 131 comprises a substrate 131*a* on which is formed an inner photoconductive layer 131*b* which is sensitive to red light. A transparent insulating layer 131*c* is formed on the layer 131*b*. An outer photoconductive layer 131*d* which is insensitive to red light is formed on the layer 131*c*. Finally, a transparent insulating layer 131*e* is formed on the layer 131*d*.

Figure 16A:
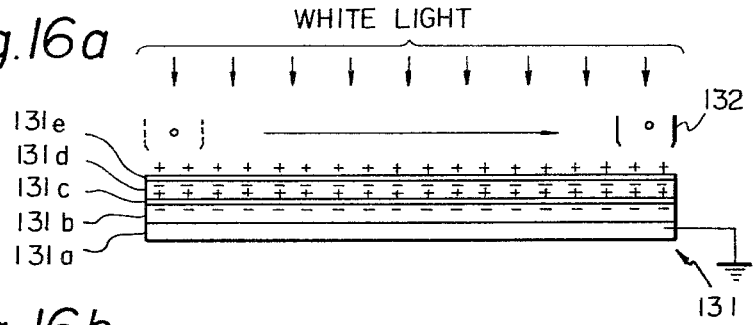
FIGS. 16*a* to 16*e* are diagrams illustrating another process and material of the invention.

In the first step of FIG. 16*a* the material 131 is radiated with white light while a corona charging unit 132 applies a positive charge thereto. Both layers 131*b* and 131*d* conduct with the result that positive charges are formed at the upper surfaces of the layers 131*c* and 131*e* and negative charges are formed at the lower surfaces of the layers 131*c* and 131*e*.

Figure 16B:
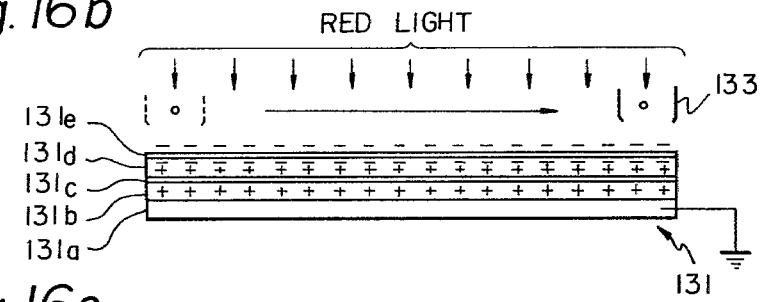

In the step of FIG. 16*b* the material 131 is radiated with red light while a charger 133 applies a negative charge thereto. Only the layer 131*b* is rendered photoconductive and a positive charge is formed at the upper surface thereof. A negative charge is formed at the upper surface of the layer 131*e*.

Figure 16C:
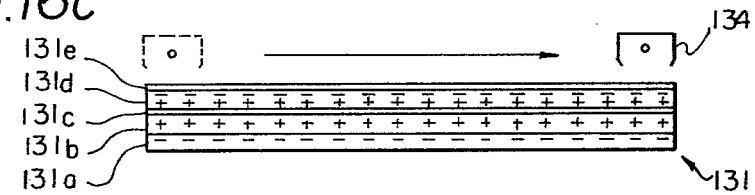

In the step of FIG. 16*c* the charge on the upper surface of the layer 131*e* is removed by a corona charging unit 134 which applies a positive charge.

Figure 16D:
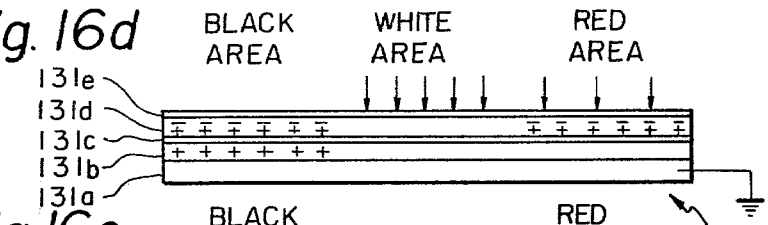

In the step of FIG. 16*d* a color light image is radiated onto the material 131. All charge is dissipated in the white image areas.

Figure 17:
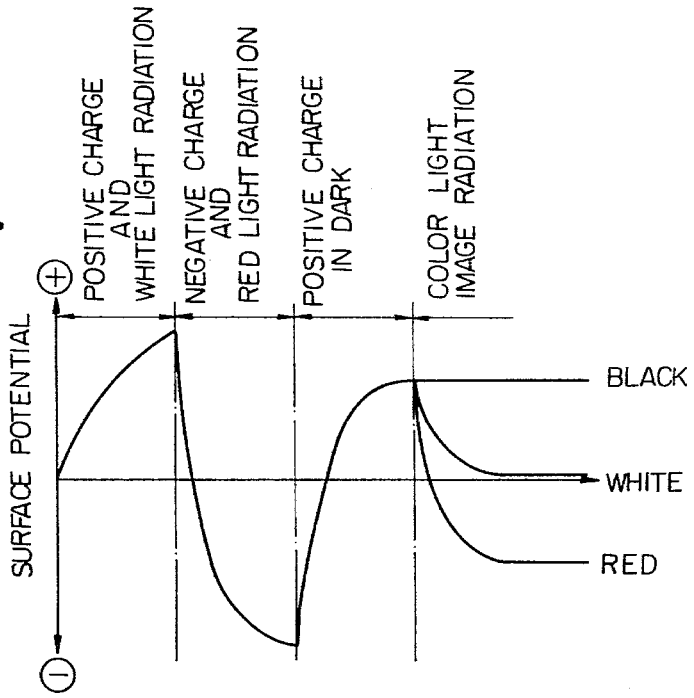
FIG. 17 is a graph illustrating the process of FIGS. 16*a* to 16*e*.

As illustrated in FIG. 17, it will be noted that the surface potential at the conclusion of the step of FIG. 16*c* is positive. This is because the net charge in the layer 131*d* is zero and the charges at the upper and lower surfaces thereof result from polarization. Thus, the positive charge at the upper surface of the layer 131*b* causes the surface potential of the material 131 to be positive. Since there is no conduction in the black image areas in the step of FIG. 16*d*, the surface potential in the black image areas remains positive.

In the red image areas only the layer 131*b* is rendered photoconductive. This results in dissipation of all charge in the layers 131*a* and 131*b*. Thus, the negative charge at the upper surface of the layer 131*d* predominates, and the surface potential of the material 131 in the red image areas is negative.

Figure 16E:
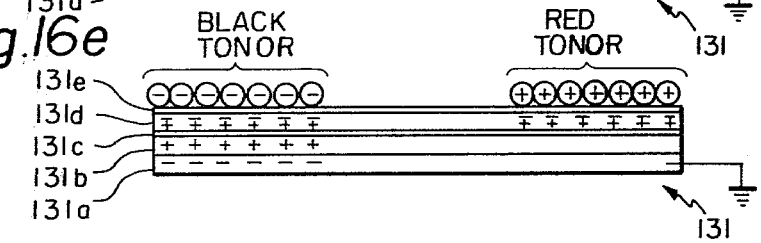

The final step of FIG. 16*e* is to develop the bipolar electrostatic image using negatively charged black toner and positively charged red toner.

Figure 18:
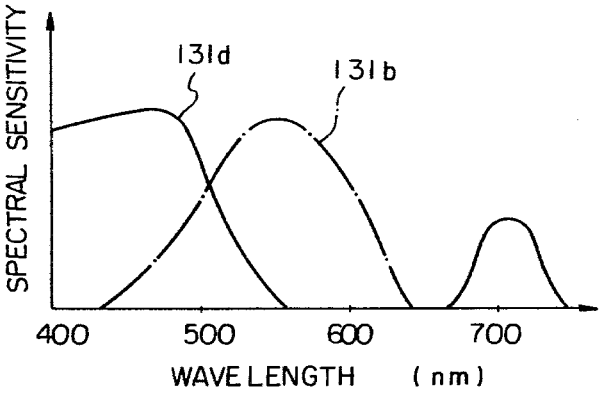
FIG. 18 is a graph illustrating the spectral sensitivities of a photoconductive material used in the process of FIGS. 16*a* to 16*e*.

The spectral sensitivity of the layer 131*b* is shown in solid line in FIG. 18. The spectral sensitivity of the layer 131*d* is similarly shown in broken line in the same drawing.

FIGS. 19*a* to 19*e* illustrate yet another process and material of the present invention. The steps of this process generally correspond to the steps of FIGS. 16*a* to 16*c*. A material 141 comprises a substrate 141*a*, inner photoconductive layer 141*b*, insulating layer 141*c*, outer photoconductive layer 141*d* and outer insulating layer 141*e* which correspond to the material 131. However, the material 141 further comprises an insulating layer 141*f* formed between the substrate 141*a* and the layer 141*b*.

Figure 19A:
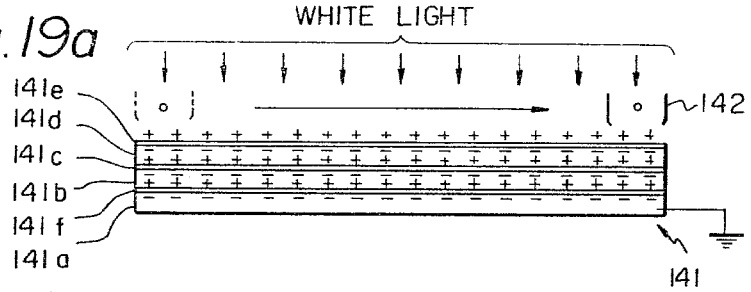
FIGS. 19*a* to 19*e* are diagrams illustrating yet another process and material of the invention.

In the step of FIG. 19*a* the material 141 is radiated with white light while a corona charging unit 142 applies a positive charge thereto. This causes positive charges to be formed at the upper surfaces of the layers 141*c*, 141*e* and 141*f* and negative charges at the lower surfaces thereof since both layers 141*b* and 141*d* are rendered photoconductive.

Figure 19B:
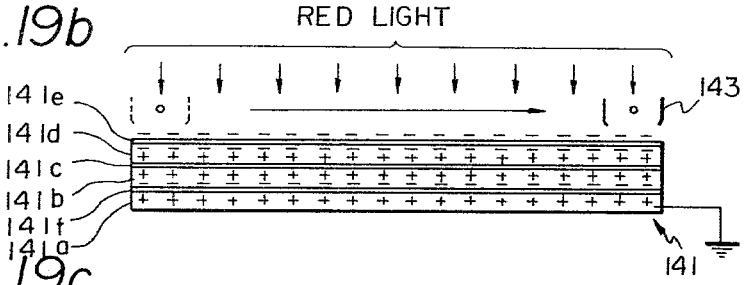
Figure 19C:
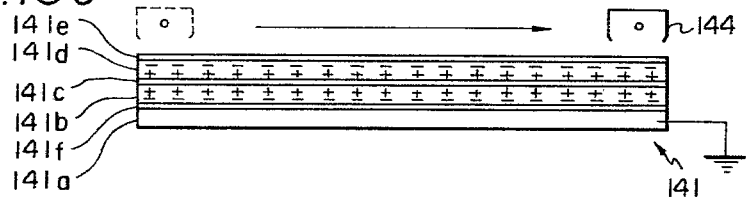

In the step of FIG. 19*b* the material 141 is radiated with red light and charged to a negative polarity by a corona charging unit 143. Only the layer 141*b* is rendered photoconductive causing reversal of polarity in the layer 141*b* and at the upper surface of the layer 141*e*. In the step of FIG. 19*c* a corona charging unit 144 applies a positive charge to the material 141 in the dark which removes the surface charge from the layer 141*e*.

Figure 19D:
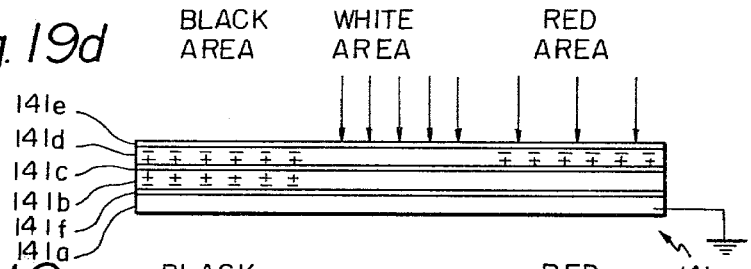

In the step of FIG. 19*d* a color light image is radiated onto the material 141. Both layers 141*b* and 141*d* conduct in the white image areas and all charge is dissipated.

In the black image areas there is no photoconduction and the positive charge at the upper surface of the layer 141*b* causes the surface potential of the material 141 to be positive.

In the red areas only the layer 141*b* conducts and the charge therein is dissipated. The negative charge at the upper surface of the layer 141*d* causes the surface potential of the material 141 to be negative.

Figure 19E:
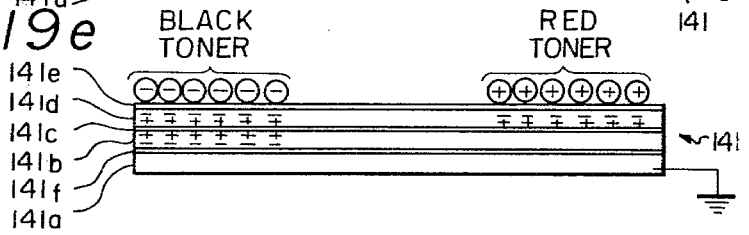

In the step of FIG. 19*e* the material 141 is developed using negatively charged black toner and positively charged red toner.

The following experiments are examples of the processes of FIGS. 16*a* to 16*e* and 19*a* to 19*e*.

EXAMPLE 1

Selenium of a purity of 99.9% was vacuum deposited to a thickness of 50 microns onto an aluminum substrate at a temperature of 74° C. to constitute a first photoconductive layer. This layer corresponds to the layer 141*b*.

After this process step the drum was left in the dark for a week.

Then, a 2 micron thick transparent insulating layer of polyester resin marketed under the tradename U-POLYMER by the Asahi Kasei Co. Ltd. of Japan was applied to the drum by dipping. Then, a zinc oxide resin having a proportion of zinc oxide to resin of 3:1 by weight which was sensitized with rose bengale was coated on the drum with a doctor blade to a thickness of 15 microns to form an outer photoconductive layer. This layer corresponds to the layer 141*d*. Then, another 5 micron thick layer of U-POLYMER was coated on the drum to form another transparent insulating layer. It will be noted that the selenium layer is sensitive to red light whereas the zinc oxide layer is insensitive to red light. The volume resistivity of the U-POLYMER layers was over $10^{16}$ Ωcm.

A first charge of +1,200 V was applied to the drum while radiating the same with white light. Then, the drum was charged again to −1,700 V in the dark. This is possible due to the properties of the selenium layer by which holes injected into the selenium layer from the substrate migrate therethrough to the lower surface of the inner insulating layer. It will be noted that such charge injection is not possible with the material 141. This is because the charges would be blocked by the layer 141*f*.

Then, a corona discharge of +4.5 KV was applied to remove charge from the upper surface of the layer 141*e*. The surface potential at the conclusion of this step was +550 V.

After radiation of a color light image onto the material the potential in the white image areas was −40 V. The surface potential in the black image areas was +520 V. The surface potential in the red image areas was −310 V. The intensity of illumination in the white areas was 10 $\mu W/cm^2$.

The bipolar electrostatic image was developed using a magnetic brush developing system. A negatively charged black toner used in the experiment was marketed under the tradename of Xerox 3100. A positively charged red toner used in the experiment was an experimental product of the Ricoh Co., Ltd. of Japan. The results of the experiment were excellent.

EXAMPLE 2

A six layer material was prepared by adding a 1 micron thick U-POLYMER layer between the aluminum substrate and the selenium layer of example 1. The process of example 1 was repeated with the difference that the second charge was applied while radiating the material with light having a wavelength range of 550 to 600 nm rather than in the dark. The results were similarly excellent.

In summary, it will be seen that the present invention provides an improved two color copying process, material and apparatus which produce even higher quality copies than the previously proposed process and may be embodied at high speed and low cost. Various modifications will become possible for those skilled in the art after receiving the teachings of the present disclosure without departing from the scope thereof. For example, although the processes illustrated and described utilize a photoconductive material having one layer sensitive to red light and another layer insensitive to red light, the color red may be replaced by any other predetermined color such as blue, green, yellow or the like.

What is claimed is:

1. A two color electrophotographic process comprising the steps of:

(a) providing a material including a first photoconductive layer which is insensitive to light of a predetermined color and sensitive to light of at least one other color, a second photoconductive layer which is sensitive to light of the predetermined color and a first transparent electrically insulating layer;

(b) forming uniform electrostatic charges of opposite polarities at outer surfaces of the first and second photoconductive layers respectively;

(c) radiating a color light image onto an outer surface of the material; and (d) applying two toners of different colors which are charged to opposite electrostatic polarities respectively to the outer surface of the material.

2. A process as in claim 1, in which step (b) comprises rendering the first and second photoconductive layers uniformly conductive while applying a first electrostatic charge to the outer surface of the material and subsequently rendering only the second photoconductive layer conductive while applying a second electrostatic charge to the outer surface of the material having a polarity opposite to the first electrostatic charge.

3. A process as in claim 2, in which step (b) comprises rendering the first and second photoconductive layers conductive by radiating white light onto the material.

4. A process as in claim 2, in which step (b) comprises rendering only the second photoconductive layer conductive by radiating light of the predetermined color onto the material.

5. A process as in claim 2, in which step (b) further comprises subsequently applying an electrostatic charge having a polarity equal to the first electrostatic charge to the outer surface of the material in the dark.

6. A process as in claim 2, in which step (b) comprises rendering only the second photoconductive layer conductive by injecting electrostatic charge into the second photoconductive layer.

7. A process as in claim 1, in which the first insulating layer is formed at the outer surface of the material, the process further comprising the step, performed between steps (b) and (c) of;

(e) removing electrostatic charge from the outer surface of the material.

8. A process as in claim 7, in which step (e) comprises applying an electrostatic charge to the outer surface of the material of a polarity selected to neutralize existing electrostatic charge on the outer surface of the material.

9. A process as in claim 7, in which step (e) comprises applying an alternating electrostatic charge to the outer surface of the material.

10. A process as in claim 7, in which step (e) comprises applying an electrically conductive liquid to the outer surface of the material.

11. A process as in claim 1, in which the first insulating layer is formed between the first and second photoconductive layers, step (b) comprising rendering the first and second photoconductive layers conductive while applying a first electrostatic charge of a first polarity to the outer surface of the material, subsequently rendering only the second photoconductive layer conductive while applying a second electrostatic charge of a second polarity to the outer surface of the material and subsequently rendering the first and second photoconductive layers non-conductive while applying a third electrostatic charge of the first polarity to the outer surface of the material.

12. A process as in claim 1, in which the first insulating layer is formed between the first and second photoconductive layers, the material further including a second transparent electrically insulating layer formed on the outer surface of the photoconductive member, step (c) further comprising simultaneously reducing an outer surface potential of the material to zero, the process further comprising the step, performed between steps (c) and (d), of:

(f) rendering the first and second photoconductive layers conductive.

13. A process as in claim 12, in which step (f) comprises radiating white light onto the material.

14. A process as in claim 12, in which step (c) comprises reducing the outer surface potential of the material to zero by applying an electrostatic charge to the outer surface of the material of a polarity selected to neutralize existing electrostatic charge on the outer surface of the material.

15. A process as in claim 12, in which step (c) comprises reducing the outer surface potential of the material to zero by applying an alternating electrostatic charge to the outer surface of the material.

16. A process as in claim 1, in which the first insulating layer is formed at the outer surface of the material, the material further including a second electrically insulating layer formed at an inner surface of the material and a third electrically insulating layer formed between the inner and outer photoconductive layers, step (b) comprising rendering the first and second photoconductive layers conductive while applying an electrostatic charge of a first polarity to the outer surface of the material and applying an electrostatic charge of a second polarity to the inner surface of the material and subsequently rendering only the second photoconductive layer conductive while applying an electrostatic charge of the second polarity to the outer surface of the material and applying an electrostatic charge of the first polarity to the inner surface of the material.

17. A process as in claim 16, in which step (c) further comprises simultaneously applying an electrostatic charge of the first polarity to the outer surface of the material while applying an electrostatic charge of the second polarity to the inner surface of the material.

18. A two color electrophotographic process comprising the steps of:

(a) providing a material including a conductive substrate, an inner photoconductive layer insensitive to light of a first color and sensitive to light of a second color, a transparent electrically insulating layer and an outer photoconductive layer sensitive to light of the first color and insensitive to light of the second color;

(b) radiating light of the first and second colors onto the material while applying a first electrostatic charge to an outer surface of the material;

(c) radiating light of the second color onto the material while applying a second electrostatic charge to the outer surface of the material having a polarity opposite to the first electrostatic charge;

(d) applying a third electrostatic charge of the same polarity as the first electrostatic charge to the outer surface of the material;

(e) radiating a color light image onto the outer surface of the material; and (f) applying two toners of different colors which are charged to opposite electrostatic polarities respectively to the outer surface of the material.

19. A process as in claim 18, in which the transparent insulating layer is formed between the inner and outer photoconductive layers, the insulating layer absorbing light of the first color.

20. A process as in claim 19, in which a second transparent electrically insulating layer is formed between the conductive substrate and the inner photoconductive layer.

21. A process as in claim 20, in which a third transparent electrically insulating layer is formed on the outer surface of the material.

* * * * *